US008408533B2

(12) United States Patent
Fuda

(10) Patent No.: US 8,408,533 B2
(45) Date of Patent: Apr. 2, 2013

(54) SHEET FEEDER AND IMAGE FORMING APPARATUS

(75) Inventor: Munehisa Fuda, Miyagi (JP)

(73) Assignee: Ricoh Company Limited, Tokyo (JP)

( * ) Notice: Subject to any disclaimer, the term of this patent is extended or adjusted under 35 U.S.C. 154(b) by 69 days.

(21) Appl. No.: 12/929,322

(22) Filed: Jan. 14, 2011

(65) Prior Publication Data

US 2011/0193284 A1 Aug. 11, 2011

(30) Foreign Application Priority Data

Feb. 8, 2010 (JP) ..... 2010-025002

(51) Int. Cl.
*B65H 3/12* (2006.01)

(52) U.S. Cl. ..... 271/96; 271/90; 271/97; 271/98

(58) Field of Classification Search ..... 271/90, 271/96–98
See application file for complete search history.

(56) References Cited

U.S. PATENT DOCUMENTS

| | | | | | |
|---|---|---|---|---|---|
| 3,168,307 | A * | 2/1965 | Munchbach et al. | ..... | 271/97 |
| 3,994,488 | A * | 11/1976 | Takenaka et al. | ..... | 271/98 |
| 3,999,795 | A * | 12/1976 | Barker | ..... | 294/185 |
| 4,893,804 | A * | 1/1990 | Sasage et al. | ..... | 271/3.09 |
| 6,102,393 | A * | 8/2000 | Kida et al. | ..... | 271/303 |
| 6,575,450 | B2 * | 6/2003 | Blackwell et al. | ..... | 271/11 |
| 7,364,150 | B2 * | 4/2008 | Nakane | ..... | 271/97 |
| 8,042,799 | B2 * | 10/2011 | Clark | ..... | 271/108 |
| 2005/0133980 | A1 * | 6/2005 | Koga | ..... | 271/97 |
| 2010/0270730 | A1 * | 10/2010 | Asari et al. | ..... | 271/108 |

FOREIGN PATENT DOCUMENTS

| | | | |
|---|---|---|---|
| JP | 06199437 | A * | 7/1994 |
| JP | 3529916 | A | 4/1997 |
| JP | 3529916 | A | 3/2004 |
| JP | 3529916 | B2 | 3/2004 |
| JP | 2007045630 | A | 2/2007 |
| JP | 2009057155 | A | 3/2009 |

OTHER PUBLICATIONS

Abstract of JP 09-110207 published on Apr. 28, 1997.

* cited by examiner

*Primary Examiner* — Prasad Gokhale
(74) *Attorney, Agent, or Firm* — Harness, Dickey & Pierce, P.L.C.

(57) ABSTRACT

A sheet feeder attracts a topmost sheet on a sheet conveyor belt as a conveying member and conveys the sheet toward an image forming unit in a subsequent step. The sheet feeder includes a vane rotation direction control unit that serves as a suction direction control unit controlling a direction in which a suction blower as an air suction unit sucks air to be reversed as a positive pressure generating unit that generates a positive pressure in a sheet suction unit. The vane rotation direction control unit controls the direction in which the suction blower sucks air to be reversed immediately after a feeding operation ends to generate the positive pressure in the sheet suction unit.

15 Claims, 6 Drawing Sheets

SHEET FEEDER AND IMAGE FORMING APPARATUS

CROSS-REFERENCE TO RELATED APPLICATIONS

The present application claims priority to and incorporates by reference the entire contents of Japanese Patent Application No. 2010-025002 filed in Japan on Feb. 8, 2010.

BACKGROUND OF THE INVENTION

1. Field of the Invention

The present invention relates to a sheet feeder provided to an image forming apparatus, and more particularly, relates to a sheet feeder that feeds a sheet from a feed tray and an image forming apparatus provided with the sheet feeder.

2. Description of the Related Art

In a sheet feeder provided on an image forming apparatus and the like, it is necessary to send out a plurality of sheets such as recording sheets stacked in a feed tray one by one accurately. This requires a separation mechanism to separate the stacked sheets one by one. For the separation mechanism, a frictional separation method is widely used in which a sheet sent from a feed tray by a pickup roller is separated and fed by frictional force. Examples of the frictional separation type separation mechanism include a combination of a separation roller and a friction pad, a combination of a separation roller and a reverse roller, and the like.

As a sheet feeder provided with a separation mechanism different from the friction separation type, Japanese Patent Application Laid-open No. 2007-45630 discloses a conventional sheet feeder that attracts a sheet on a conveying member by a negative pressure to separate and feed the sheet.

In the conventional sheet feeder, a sheet suction unit is located inside a sheet conveyor belt as an endless belt. The sheet conveyor belt is disposed at a position facing the topmost sheet on top of a plurality of stacked sheets in a feed tray. The conventional sheet feeder is further provided with a blower device that blows air toward the leading edge of the sheets in the feed tray.

In such a sheet feeder, when a feed command is received from an image forming apparatus, operations of a suction device that generates a negative pressure in the sheet suction unit and the blower device are started while the sheet conveyor belt is being stopped. The blower device in operation blows air toward the leading edge of the sheets in the feed tray, which separates and lifts the topmost sheet from the other sheets below. A countless number of suction holes are formed over the entire sheet conveyor belt. Operating the suction device generates a negative pressure in the sheet suction unit, and the negative pressure acts below the sheet conveyor belt through the suction holes, whereby the topmost sheet lifted is attracted on the sheet conveyor belt.

After an elapse of a given period of time from the start of the operations of the suction device and the blower device, an endless movement of the sheet conveyor belt is started while the suction device and the blower device are in operation. Consequently, the topmost sheet attracted on the sheet conveyor belt is conveyed toward a subsequent step, and then an image is formed.

After the first topmost sheet is conveyed, the second topmost sheet subsequently positioned at the top is attracted on the sheet conveyor belt when the trailing edge of the first topmost sheet starts passing through the suction area of the sheet suction unit. Consequently, immediately after the second topmost sheet is attracted on the sheet conveyor belt, the leading edge of the second topmost sheet and the trailing edge of the first topmost sheet overlap each other. Therefore, if the endless movement of the sheet conveyor belt is successively continued, the second topmost sheet may be conveyed together with the first topmost sheet, resulting in so-called double feed. Accordingly, when it is detected that the topmost sheet reaches the position where a conveyance force is applied by a downstream conveying member located on the downstream of the sheet conveyor belt in the sheet conveying direction, the endless movement of the sheet conveyor belt is stopped. In this case, the downstream conveying member is driven while the sheet conveyor belt is being stopped. As a consequence, while the first topmost sheet is being conveyed continuously, the conveyance of the second topmost sheet that is attracted on the sheet conveyor belt when the trailing edge of the first topmost sheet starts passing through the suction area is stopped, whereby double feed is prevented.

Thereafter, according to a predetermined feeding interval, the endless movement of the sheet conveyor belt is resumed after an elapse of a predetermined time from the time the sheet conveyor belt is stopped. Accordingly, the second topmost sheet attracted on the sheet conveyor belt is conveyed toward the subsequent step similarly to the first topmost sheet.

While the blower device, the suction device, and the downstream conveying member are in operation, the endless movement of the sheet conveyor belt is controlled ON and OFF, whereby the sheets in the feed tray are sequentially fed one by one toward an image forming unit.

When the feeding of a specified number of sheets is completed, the operations of the blower device, the suction device, the sheet conveyor belt, and the downstream conveying member are stopped to end the feeding operation performed by the sheet feeder.

In the sheet feeder that attracts the sheet on the conveying member by a negative pressure, stopping the operations of the blower device, the suction device, the sheet conveyor belt, and the downstream conveying member stops the feeding of sheets to the subsequent step. However, the negative pressure in the sheet suction unit is not released immediately. After the suction device is stopped, the negative pressure in the sheet suction unit gradually approaches the atmospheric pressure. Therefore, at the time the feeding operation ends, the suction power for an end-of-feeding topmost sheet, i.e., a sheet positioned on the top in the feed tray when the feeding ends, remains to be held.

When the negative pressure in the sheet suction unit gradually approaches the atmospheric pressure and the self weight of the sheet exceeds the suction power for the end-of-feeding topmost sheet, the end-of-feeding topmost sheet falls onto a bundle of sheets in the feed tray by its own weight. When the end-of-feeding topmost sheet is of a lightweight such as a small thin sheet, it may take several tens of seconds for the sheet to fall onto the bundle of sheets in the feed tray after the feeding operation ends.

The sheet feeder is designed to allow the feed tray to be drawn out from the body to replenish the feed tray that has lost sheets by feeding or to replace sheets. When drawing out the feed tray from the body, if the end-of-feeding topmost sheet is held attracted on the sheet conveyor belt, the sheet may be damaged or the sheet may fall into an area inside the device where a user cannot reach.

The user is aware that the sheet is held attracted on the belt when the feed tray is drawn out immediately after the feeding ends based on experience or from a notice given in a user's manual. Consequently, the user draws out the feed tray after waiting for some time since the feeding ends.

Therefore, when drawing out the feed tray, the user waits for the end-of-feeding topmost sheet that is previously loaded to fall onto the bundle of sheets in the feed tray and then draws out the feed tray. This may make the user wait for several tens of seconds after the feeding operation ends, thereby causing a large waste of time each time sheets are replenished or replaced.

SUMMARY OF THE INVENTION

It is an object of the present invention to at least partially solve the problems in the conventional technology.

According to an aspect of the present invention, a sheet feeder includes a feed tray, a sheet suction unit, an air suction unit, a sheet conveying unit, and a positive pressure generating unit. The feed tray is configured to contain a stack of sheets. The sheet suction unit sucks a topmost sheet on top of the sheets stacked in the feed tray by a negative pressure generated at a position facing a top surface of the topmost sheet. The air suction unit is connected to the sheet suction unit via an air flow passage and sucks air from the sheet suction unit side to generate the negative pressure in the sheet suction unit. The sheet conveying unit includes a conveying member and attracts the topmost sheet sucked by the sheet suction unit on the conveying member to convey the topmost sheet toward a subsequent step. The positive pressure generating unit generates a positive pressure in the sheet suction unit.

According to another aspect of the present invention, an image forming apparatus includes an image forming unit that forms an image on a sheet as a recording medium and a sheet feeder that feeds the sheet to the image forming unit. The sheet feeder includes a feed tray, a sheet suction unit, an air suction unit, a sheet conveying unit, and a positive pressure generating unit. The feed tray is configured to contain a stack of sheets. The sheet suction unit sucks a topmost sheet on top of the sheets stacked in the feed tray by a negative pressure generated at a position facing a top surface of the topmost sheet. The air suction unit is connected to the sheet suction unit via an air flow passage and sucks air from the sheet suction unit side to generate the negative pressure in the sheet suction unit. The sheet conveying unit includes a conveying member and attracts the topmost sheet sucked by the sheet suction unit on the conveying member to convey the topmost sheet toward a subsequent step. The positive pressure generating unit generates a positive pressure in the sheet suction unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described in detail below with reference to the accompanying drawings. First, the structure and operation of an image forming apparatus to which a sheet feeder of an embodiment is applicable will be explained.

Figure 2:
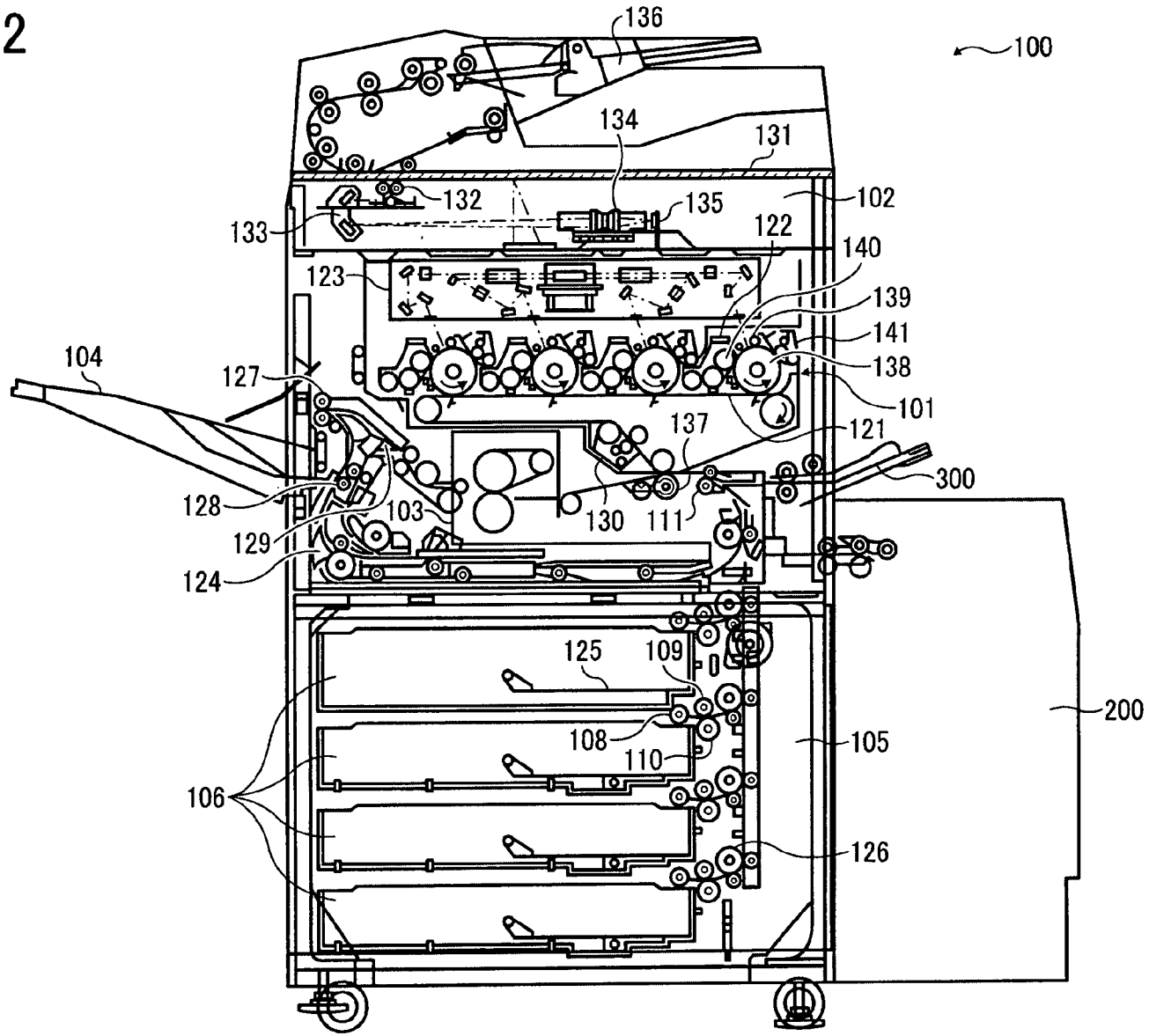
FIG. 2 is a diagram for explaining a copier according to the first embodiment.

FIG. 2 is a schematic diagram illustrating the structure of a copier 100 as an image forming apparatus according to an embodiment of the present invention.

The copier 100 has functions as a digital color copier that reads an original by scanning, digitalizes the original thus read, and duplicates the original onto a sheet.

As illustrated in FIG. 2, the copier 100 includes an image forming unit 101, a scanning unit 102, a fixing unit 103, and a discharging unit 104. On the lower portion of the copier 100 is provided a multi-stage feed unit 105. In respective stages of the feed unit 105, a plurality of main body feed trays 106 each stacked with a recording medium in sheet such as plain paper, coated paper such as coat paper, and an OHP transparency sheet (hereinafter, referred to as sheet) is arranged. In each of the main body feed trays 106, a main body tray bottom plate 125, a pickup roller 108, a feed roller 109, a reverse roller 110, and a feed roller 126 are disposed. The main body tray bottom plate 125 is structured to move up and down in the vertical direction depending on the remaining number of sheets stacked inside the main body feed tray 106. The pickup roller 108 applies a conveyance force to the sheet on top of the sheets placed and conveys the sheet toward a pair of rollers including the feed roller 109 and the reverse roller 110. The feed roller 109 and the reverse roller 110 constitute a separating unit that conveys only a single sheet at the top toward the feed roller 126 when a plurality of sheets is conveyed by the pickup roller 108.

More specifically, a single sheet at the top in the main body feed tray 106 is supplied by the rotation of the pickup roller 108 and is separated one by one by the reverse roller 110.

The separated sheet is sent out from the main body feed tray 106 by the rotation of the feed roller 109 and the feed roller 126 and is conveyed to a pair of registration rollers 111 in the image forming unit 101 disposed on the downstream side in the sheet conveying direction. The sheet thus separated and conveyed is temporarily held to wait by abutting on a nip of the pair of registration rollers 111. The sheet is then sent to a secondary transfer nip for image forming.

The scanning unit 102 includes an exposure glass 131 the upper surface of which contacts a scanning surface of the original, and a lens 134 and a charge-coupled device (CCD) camera 135 for reading an original image as image information. The scanning unit 102 is also provided with a first traveling body 132 that has a light source and a reflective mirror and moves corresponding to a document read position, and a second traveling body 133 that moves in response to the movement of the first traveling body 132 so that the distance of an optical path from the reflective mirror in the first traveling body 132 to the CCD camera 135 remains constant. On the upper portion of the scanning unit 102, an automatic document feeder 136 is disposed.

In the substantially central portion of the image forming unit 101, an intermediate transfer belt 121 is disposed and, on the upper portion of the intermediate transfer belt 121, four image forming units 122 each of which forms a toner image in respective colors on a photosensitive element 138 corresponding to the respective colors are disposed. In the periphery of the photosensitive element 138 of each image forming unit 122, a charging unit 139 that uniformly charges the surface of the photosensitive element 138, a developing unit 140 that develops a latent image formed on the surface of the photosensitive element 138 as a toner image, a photosensitive element cleaning device 141 that removes the toner image remaining on the surface of the photosensitive element 138 after the toner image is transferred onto the intermediate transfer belt 121, and the like are disposed. Above the four image forming units 122, an exposing unit 123 that irradiates the photosensitive elements of the image forming units 122 of respective colors with exposure lights corresponding to the respective colors to form the latent images on the photosensitive elements is disposed.

Below the intermediate transfer belt 121 is a secondary transfer roller 137 that forms the secondary transfer nip with the intermediate transfer belt 121 therebetween. On the downstream side in a moving direction of the surface of the intermediate transfer belt 121 with respect to the secondary transfer nip, an intermediate transfer belt cleaning device 130 that removes residual toner remaining on the surface of the intermediate transfer belt 121 after passing through the secondary transfer nip is disposed.

Further below the fixing unit 103 located below the intermediate transfer belt 121 is a duplex device 124 that conveys the sheet having an image formed on its front surface by the fixing unit 103 toward the transfer position with its rear surface facing up. On the left side of the fixing unit 103 in FIG. 2 are arranged discharging rollers 127 that discharge the sheet having an image formed on its front surface by the fixing unit 103 toward the discharging unit 104. Further below the discharging rollers 127 are arranged reverse discharging rollers 128 that discharge the sheet to the discharging unit 104 such that the front surface of the sheet having an image formed faces downward. Between the fixing unit 103 and the discharging rollers 127 is a bifurcating claw 129 that switches a conveying path of the sheet passing through the fixing unit 103 to a conveying path heading toward the discharging rollers 127 or a conveying path heading toward the reverse discharging rollers 128 or the duplex device 124.

The copier 100 according to the embodiments is provided with a sheet feeder 200 as a separate feed unit from the feed unit 105, and a bypass tray 300 above the sheet feeder 200. When images are being formed, sheets are sequentially supplied being separated one by one from the main body feed tray 106 selected in the feed unit 105, the bypass tray 300, or the sheet feeder 200.

The sheet feeder 200 according to the embodiment will now be described.

Figure 3:
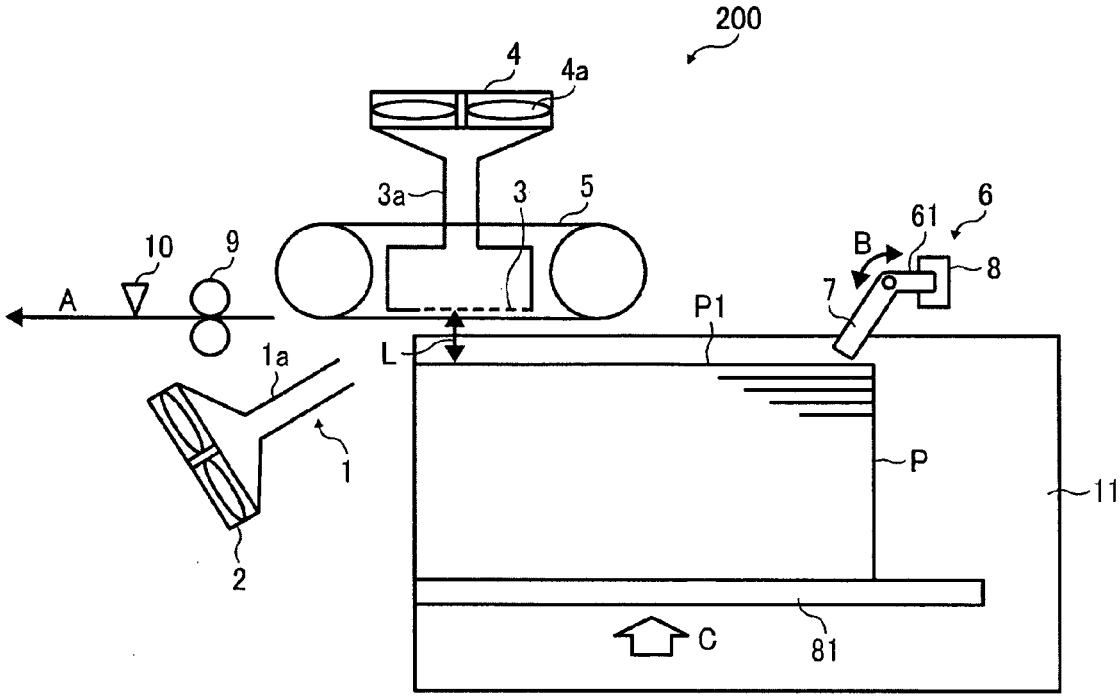
FIG. 3 is a diagram for explaining the sheet feeder according to the first embodiment.

FIG. 3 is a schematic diagram illustrating the structure of the sheet feeder 200. As illustrated in FIG. 3, the sheet feeder 200 has a feed tray 11 and a feed unit 50. The feed tray 11 contains sheets P stacked on a bottom plate 81. The feed unit 50 is a sheet conveying unit provided with an endless sheet conveyor belt 5 having a sheet suction unit 3 disposed inside. The sheet suction unit 3 is connected to a suction blower 4 that is a suction device via a duct 3*a* that is an air flow passage. Provided also is a blower device 1 that blows air toward the vicinity of the leading edge, in the conveying direction (arrow A direction in FIG. 3), of a topmost sheet P1 positioned on top of the sheets P in the feed tray 11.

In FIG. 3, while the duct 3*a* is illustrated as if it passes through the upper surface of the sheet conveyor belt 5 for the convenience sake of drawing, the duct 3*a* is actually extended toward outside of a loop of the sheet conveyor belt 5 from an opening on the side (front-back direction of the drawing) of the loop of the sheet conveyor belt 5 and connected to the suction blower 4.

The suction blower 4 pumps air by rotating a rotary vane 4*a* that is a rotating body to generate air flow, whereby a negative pressure is generated on one side of the rotation axis of the rotary vane 4*a* as a suction side and a positive pressure is generated on the other side as an exhaust side. With the suction blower 4, reversing the rotation of the rotary vane 4*a* inverts the suction side and the exhaust side. In the embodiment, the rotating direction of the rotary vane 4*a* that makes the duct 3*a* side connected to the sheet suction unit 3 become the suction side generating a negative pressure in the sheet suction unit 3 is defined as normal rotation and the rotating direction of the rotary vane 4*a* that makes the duct 3*a* side become the exhaust side is defined as reverse rotation.

Operating the suction blower 4 in normal rotation generates a negative pressure below the sheet suction unit 3, which generates suction power for the topmost sheet P1.

The blower device 1 blows air to the leading edge of the sheet P stacked in plurality in the feed tray 11 from a nozzle 1*a* connected to an air blower 2 to separate the sheet P and to lift the topmost sheet P1.

The sheet conveyor belt 5 is a conveying member and is structured with an endless belt that encircles the sheet suction unit 3. The sheet conveyor belt 5 has a countless number of suction holes opened penetrating from its inner surface through its outer surface over the entire belt. This makes the suction power generated in the sheet suction unit 3 by the negative pressure act not on the sheet conveyor belt 5 but on the topmost sheet P1 below.

Accordingly, the topmost sheet P1 lifted by air blown by the blower device 1 is sucked by the sheet suction unit 3, resulting in the topmost sheet P1 being attracted on the lower portion of the outer surface of the sheet conveyor belt 5. The sheet conveyor belt 5 receives drive transmitted via a pulley connected to a belt drive motor, and the endless movement of the sheet conveyor belt 5 by the drive conveys the attracted sheet P in the arrow A direction in FIG. 3. The conveyed sheet P is further conveyed to the image forming unit 101 of the copier 100 that is in a subsequent step and then, image forming is performed.

The sheet feeder 200 includes a sheet top sensor 6 that is a sheet height detecting unit on the upstream side in the sheet conveying direction with respect to the sheet conveyor belt 5 (the direction going from right to left in FIG. 3). The sheet top sensor 6 includes an actuator 7 that pivots about a spindle 61 in the arrow B direction indicated in FIG. 3, and a photo sensor 8 that detects the position of the actuator 7. The sheet top sensor 6 detects the height of the top surface of the topmost sheet P1 by detecting with the photo sensor 8 changes in the position of the actuator 7 that swings as the number of the sheets P in the feed tray 11 is reduced.

In the sheet feeder 200, it is necessary to maintain the distance L between the top surface of the topmost sheet P1 of the sheets P in the feed tray 11 that decreases in number by feeding and the under surface of the sheet conveyor belt 5 within a certain range. Accordingly, the height of the top surface of the topmost sheet P1 is detected by the sheet top sensor 6 and, based on a detecting signal of the sheet top sensor 6, an elevating mechanism (not illustrated) that moves the bottom plate 81 of the feed tray 11 up and down is controlled. Consequently, the height of the bottom plate 81 is adjusted and controlled such that the distance L between the top surface of the topmost sheet P1 of the sheets P placed on the bottom plate 81 and the under surface of the sheet conveyor belt 5 is within the certain range.

In the sheet feeder 200, when the number of sheets is decreased by feeding, a control unit (not illustrated) detects that the height of the top surface of the topmost sheet P1 is lowered with the sheet top sensor 6 and controls the drive of the elevating mechanism to move the bottom plate 81 upward as indicated by the arrow C in FIG. 3. When the height of the top surface of the topmost sheet P1 coming to a given height is detected by the sheet top sensor 6, the drive of the elevating mechanism is stopped.

On the downstream side in the conveying direction with respect to the sheet conveyor belt 5, a pair of carriage rollers 9 that is a downstream conveying member is located. The pair of carriage rollers 9 further convey the sheet P conveyed by the sheet conveyor belt 5 and reaching between the two rollers toward the downstream side. The conveyance force by the pair of carriage rollers 9 is set greater than that of the sheet conveyor belt 5. On the downstream side of the pair of carriage rollers 9 in the conveying direction is provided a feed sensor 10 that detects the passing of the sheet P.

The feed tray 11 has the sheet top sensor 6 and the bottom plate 81 built in and is structured to be drawn out from the body of the sheet feeder 200 in a horizontal direction crossing the conveying direction.

The feeding operation of the sheet feeder 200 will be explained.

Figure 4:
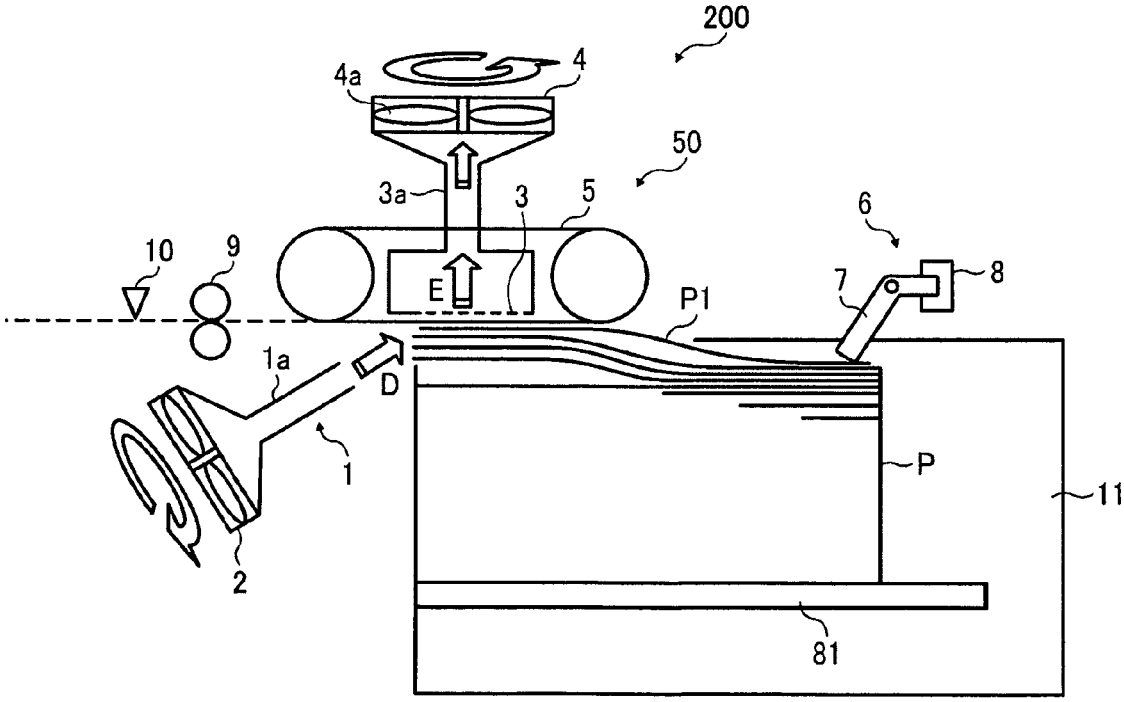
FIG. 4 is a diagram for explaining the state where air blowing and suction start on the sheet feeder according to the first embodiment.

FIG. 4 is a diagram for explaining the sheet feeder 200 immediately after the feeding operation is started. When a command to start feeding is received from the control unit of the copier 100, as illustrated in FIG. 2, the suction of the suction blower 4 and the blowing of the air blower 2 are started while the belt driving motor (not illustrated) that drives the sheet conveyor belt 5 is being stopped. When the air blower 2 is started to blow air, as indicated by the arrow D in FIG. 4, the air is blown to the leading edge of the sheet P and the topmost sheet P1 of the stacked sheets P is lifted. When the suction blower 4 starts sucking, as indicated by the arrow E in FIG. 4, a negative pressure is generated in the sheet suction unit 3 and the topmost sheet P1 lifted is attracted on the under surface of the sheet conveyor belt 5.

Figure 5:
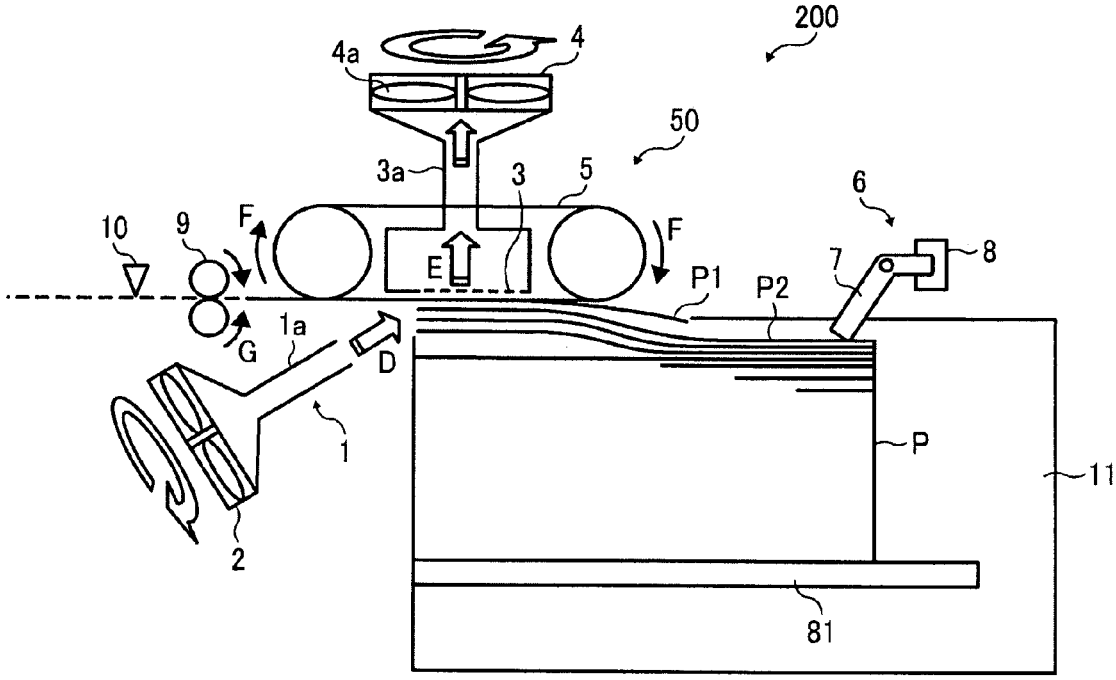
FIG. 5 is a diagram for explaining the state where a sheet conveyor belt and a pair of carriage rollers start being driven from the state illustrated in FIG. 4.

After an elapse of a predetermined time (for example, 3 seconds) from the start of the suction of the suction blower 4 and the blowing of the air blower 2, as indicated in FIG. 5, while the suction of the suction blower 4 and the blowing of the air blower 2 are in operation, the driving of the sheet conveyor belt 5 and the pair of carriage rollers 9 is started. The sheet conveyor belt 5 receives the drive transmitted and starts the surface movement of the sheet conveyor belt 5 in the arrow F direction in FIG. 5. This results in the topmost sheet P1 attracted on the under surface of the sheet conveyor belt 5 being conveyed toward the downstream side in the conveying direction and reaching the pair of carriage rollers 9. By the rotation of the pair of carriage rollers 9 in the arrow G direction in FIG. 5, the topmost sheet P1 is further conveyed to the downstream side.

Figure 6:
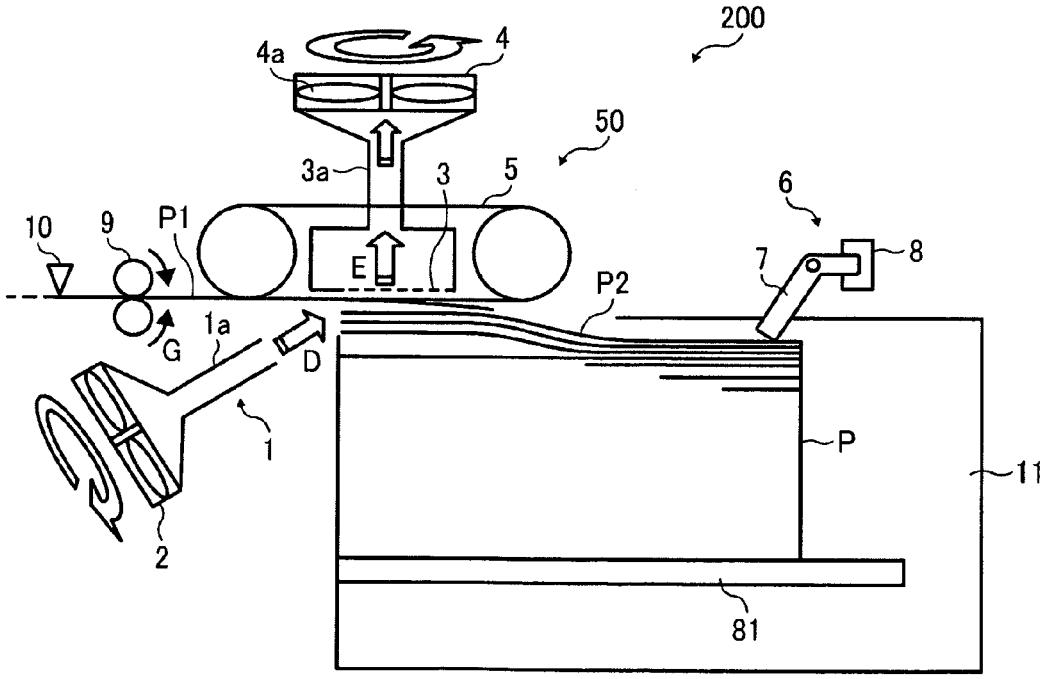
FIG. 6 is a diagram for explaining the state where the sheet conveyor belt stops being driven from the state illustrated in FIG. 5.

Thereafter, as illustrated in FIG. 6, when the leading edge of the topmost sheet P1 conveyed by the sheet conveyor belt 5 and the pair of carriage rollers 9 is detected by the feed sensor 10, the drive of the sheet conveyor belt 5 is stopped. When the drive of the sheet conveyor belt 5 is stopped while the suction of the suction blower 4 is in operation, power to stop conveying acts on the portion where the topmost sheet P1 is attracted on the sheet conveyor belt 5. However, in the sheet feeder 200, the respective members are set such that the conveyance force given to the sheet P by the pair of carriage rollers 9 is substantially greater than the power to stop conveying. Consequently, the conveyance of the topmost sheet P1 by the pair of carriage rollers 9 is continued while the sheet conveyor belt 5 is being stopped.

The sheet that comes to the top of the sheets P after the topmost sheet P1 is defined as a next topmost sheet P2, here. As indicated in FIGS. 4 to 6, while the topmost sheet P1 is attracted on the sheet conveyor belt 5, the leading edge of the next topmost sheet P2 flaps below the topmost sheet P1 as it is receiving the blowing air. Accordingly, the leading edge of the next topmost sheet P2 is being separated from the sheet P below.

Figure 7:
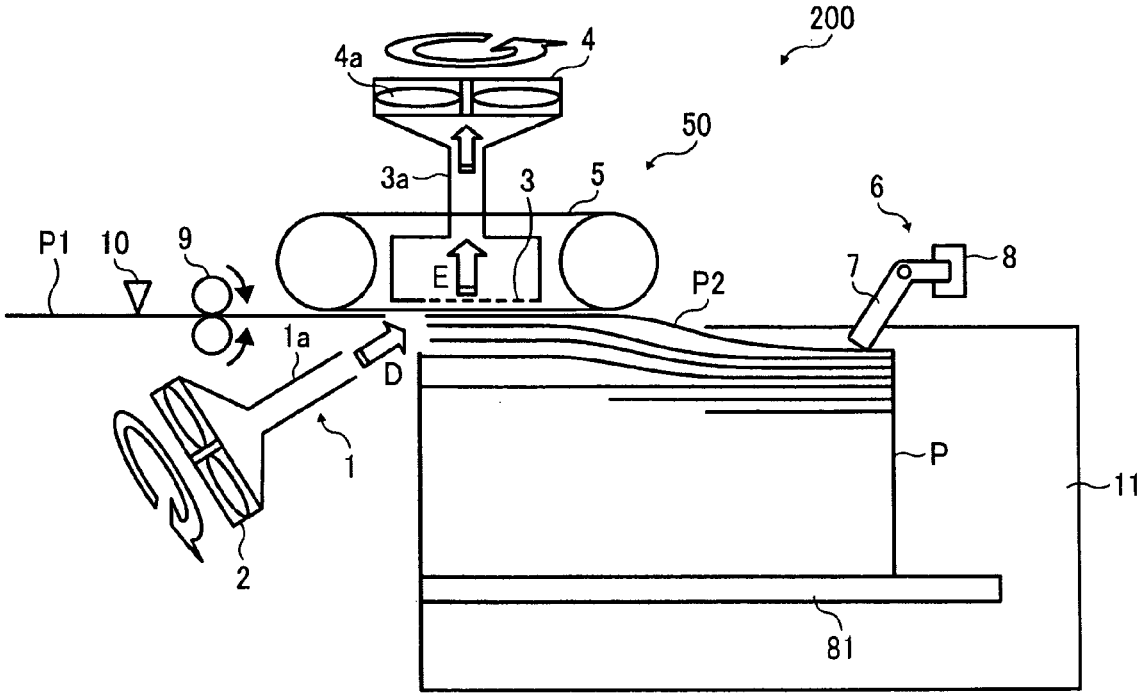
FIG. 7 is a diagram for explaining the state where the trailing edge of a sheet passes a suction area from the state illustrated in FIG. 6.

Then, immediately after the trailing edge of the topmost sheet P1 passes through the suction area of the sheet suction unit 3, as illustrated in FIG. 7, by the flow of the air formed between the blower device 1 and the sheet suction unit 3, the next topmost sheet P2 is lifted and attracted on the sheet conveyor belt 5.

Depending on a predetermined feeding interval, after an elapse of a predetermined time from the timing of the feed sensor 10 detecting the leading edge of the topmost sheet P1 as indicated in FIG. 6, the drive of the sheet conveyor belt 5 is resumed. Consequently, similarly to the topmost sheet P1 indicated in FIG. 5, the next topmost sheet P2 is conveyed by the sheet conveyor belt 5 toward the downstream side in the conveying direction reaching the pair of carriage rollers 9, and is further conveyed downstream by the pair of carriage rollers 9.

While the suction of the suction blower 4, the blowing of the air blower 2, and the rotation of the pair of carriage rollers 9 are in operation, the drive of the sheet conveyor belt 5 is controlled on and off. In this manner, the operations illustrated in FIGS. 5 to 7 are repeated to sequentially feed the sheets P one by one toward the image forming unit.

The sheet feeder (such as the sheet feeder 200) that attracts the sheet P on the sheet conveyor belt 5 by a negative pressure can feed sheets faster than a sheet feeder of the frictional separation type. The reasons for this are as follows. Because the frictional separation type sheet feeder requires a time to frictionally separate a sheet, it has certain limitations with respect to high linear speed and high productivity. Meanwhile, in the sheet feeder 200, right after the topmost sheet P1 that is the previous sheet attracted on the sheet conveyor belt 5 passes through the suction area, the next topmost sheet P2 that is the next sheet is separated from the further next sheet P and attracted on the sheet conveyor belt 5. Consequently, because the sheet feeder 200 only needs to convey with the sheet conveyor belt 5 the sheet P that is separated by the flow of air, it can handle the high linear speed and high productivity.

In the sheet feeder 200, at the time of completing the feeding of a specified number of sheets, the suction operation of the suction blower 4, the blowing operation of the air blower 2, the surface movement of the sheet conveyor belt 5, and the rotation of the pair of carriage rollers 9 are stopped to end the feeding operation of the sheet feeder 200.

Figure 8:
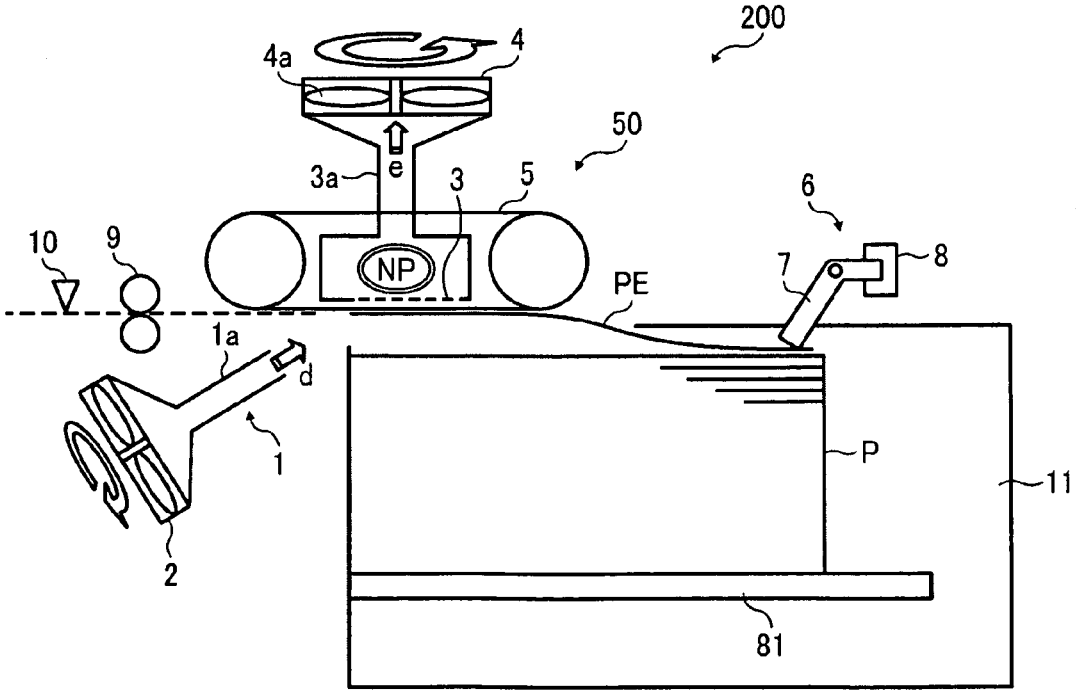
FIG. 8 is a diagram for explaining the state where driving sources for operating respective members are stopped when the feeding operation ends.

FIG. 8 is a diagram for explaining the state where the driving sources for operating the respective members are stopped after the feeding of a specified number of sheets is completed. As illustrated in FIG. 8, stopping the driving sources operating the respective members stops the surface movement of the sheet conveyor belt 5 and the rotation of the pair of carriage rollers 9, whereby the feeding of sheets toward the image forming unit 101 is no longer performed. However, because the blade of the air blower 2 and the rotary vane 4*a* of the suction blower 4 continue to rotate for a few more seconds due to inertia, the flow of air indicated by the arrows d and e in FIG. 8 is continuously formed.

When the feeding operation ends, as illustrated in FIG. 8, an end-of-feeding topmost sheet PE that is the sheet positioned at the top in the feed tray at the end of the feeding operation is still attracted on the sheet conveyor belt 5 for performing the subsequent feeding. As described above, because of the rotary vane 4*a* of the suction blower 4 rotating due to inertia, the suction power is still being held. Furthermore, even when the rotation of the rotary vane 4*a* is stopped completely, because the sheet suction unit 3 is in a hermetically closed state by the end-of-feeding topmost sheet PE attracted on the sheet conveyor belt 5, a negative pressure NP in the sheet suction unit 3 is released only gradually.

Therefore, in a conventional sheet feeder, when the negative pressure NP in the sheet suction unit 3 approaches the atmospheric pressure and the self weight of the end-of-feeding topmost sheet PE exceeds the suction power by the negative pressure NP in the sheet suction unit 3, the end-of-feeding topmost sheet PE falls on the bundle of sheets P in the feed tray 11 by its own weight. If the end-of-feeding topmost sheet PE is of a lightweight sheet such as a small thin sheet, it may take several tens of seconds for the end-of-feeding topmost sheet PE to fall on the bundle of sheets P in the feed tray 11 after the feeding operation ends.

If the feed tray 11 is drawn out while the end-of-feeding topmost sheet PE is still attracted on the sheet conveyor belt 5, the end-of-feeding topmost sheet PE may be damaged or the end-of-feeding topmost sheet PE may fall into an area inside the sheet feeder 200 where the user cannot reach.

Therefore, in the conventional sheet feeder, when the user replaces the sheet P in the feed tray 11, the user waits for the end-of-feeding topmost sheet PE previously loaded to fall into the feed tray 11 before drawing out the feed tray 11. Consequently, the user may have to wait for several tens of seconds after the feeding ends, resulting in a large waste of time each time the sheet P is replaced.

The sheet feeder 200 of the embodiment includes a positive pressure generating unit that generates a positive pressure in the sheet suction unit 3. Immediately after the feeding operation ends, a positive pressure is generated in the sheet suction unit 3 by the positive pressure generating unit. This allows the end-of-feeding topmost sheet PE attracted on the conveying member above the feed tray 11 to be pushed down onto the bundle of sheets P in the feed tray 11. Consequently, the sheet P can be replaced right after the feeding operation ends, making it possible to reduce loss time and enhance the productivity.

First Embodiment

The sheet feeder 200 according to a first embodiment will be explained.

Figure 1:
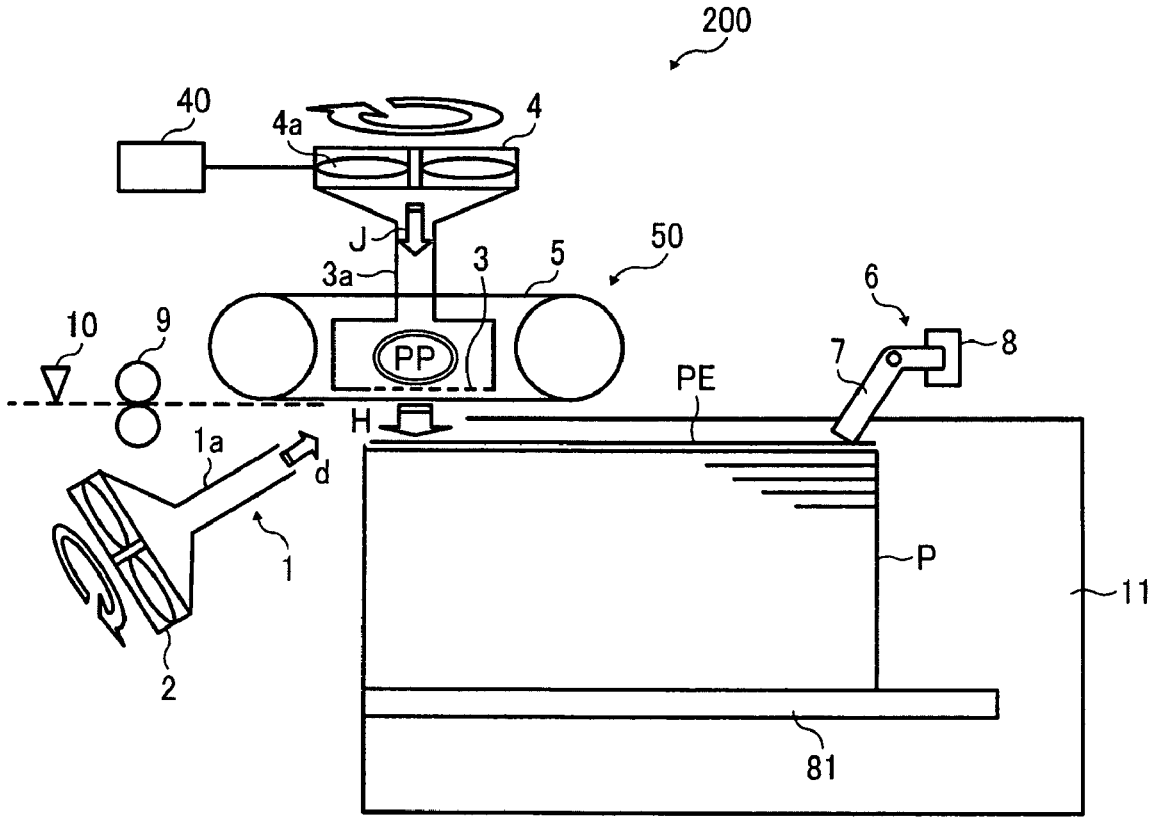
FIG. 1 is a diagram for explaining a sheet feeder according to a first embodiment of the present invention.

FIG. 1 is a diagram for explaining the sheet feeder 200 according to the first embodiment. The sheet feeder 200 of the first embodiment includes, as the positive pressure generating unit, a vane rotation direction control unit 40 that controls the direction and timing of the rotation of the rotary vane 4*a*, allowing the suction blower 4 to operate in normal rotation and in reverse rotation.

After the feeding operation ends, the sheet feeder 200 of the first embodiment stops the respective driving sources for the air blower 2, the sheet conveyor belt 5, and the pair of carriage rollers 9, and immediately controls the rotating direction of the rotary vane 4*a* of the suction blower 4 to be in reverse rotation. This inverts the suction side and the exhaust side of the suction blower 4 making the duct 3*a* side become the exhaust side, so that the suction blower 4 blows air toward the sheet suction unit 3 as indicated by the arrow J in FIG. 1. By such air blowing, a positive pressure PP is generated in the sheet suction unit 3, and the end-of-feeding topmost sheet PE attracted on the sheet conveyor belt 5 by the suction power of the sheet suction unit 3 is immediately pushed back onto the bundle of sheets P in the feed tray 11 as indicated by the arrow H in FIG. 1.

With such a structure, the sheet feeder 200 of the first embodiment allows the sheet P to be replaced immediately after the feeding operation ends, thereby reducing loss time and enhancing the productivity.

Second Embodiment

The sheet feeder 200 according to a second embodiment will be explained.

Figure 9:
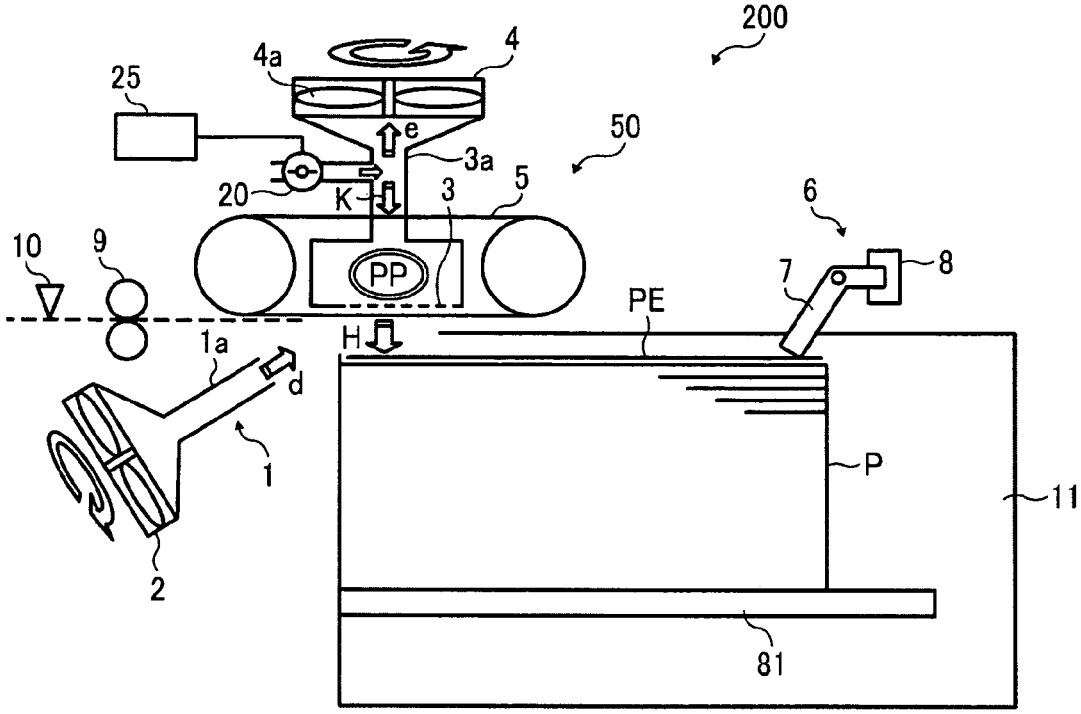
FIG. 9 is a diagram for explaining a sheet feeder according to a second embodiment of the present invention.

FIG. 9 is a diagram for explaining the sheet feeder 200 according to the second embodiment. The sheet feeder 200 of the second embodiment includes, as the positive pressure generating unit, an air release valve 20 and a release valve control unit 25. The air release valve 20 is an air releasing mechanism that opens the duct 3*a*, i.e., the flow passage connecting the suction blower 4 and the sheet suction unit 3, to the air. The release valve control unit 25 controls the operation and timing of the air release valve 20.

The release valve control unit 25 of the sheet feeder 200 according to the second embodiment controls the air release valve 20 to be closed during the feeding operation. When the feeding operation ends, the respective driving sources for the air blower 2, the suction blower 4, the sheet conveyor belt 5, and the pair of carriage rollers 9 are stopped and the release valve control unit 25 immediately controls the air release valve 20 to be opened.

Consequently, the air flows into the duct 3*a* from the air release valve 20 released. The air flowing into the duct 3*a* diverges into a flow sucked by the suction blower 4 as indicated by the arrow e in FIG. 9 and a flow blowing toward the sheet suction unit 3 as indicated by the arrow K in FIG. 9. By such air blowing, the positive pressure PP is generated in the sheet suction unit 3, and the end-of-feeding topmost sheet PE attracted on the sheet conveyor belt 5 by the suction power of the sheet suction unit 3 is immediately pushed back onto the bundle of sheets P in the feed tray 11 as indicated by the arrow H in FIG. 9.

With such a structure, the sheet feeder 200 of the second embodiment allows the sheet P to be replaced immediately after the feeding operation ends, thereby reducing loss time and enhancing the productivity.

Third Embodiment

The sheet feeder 200 according to a third embodiment will be explained.

Figure 10:
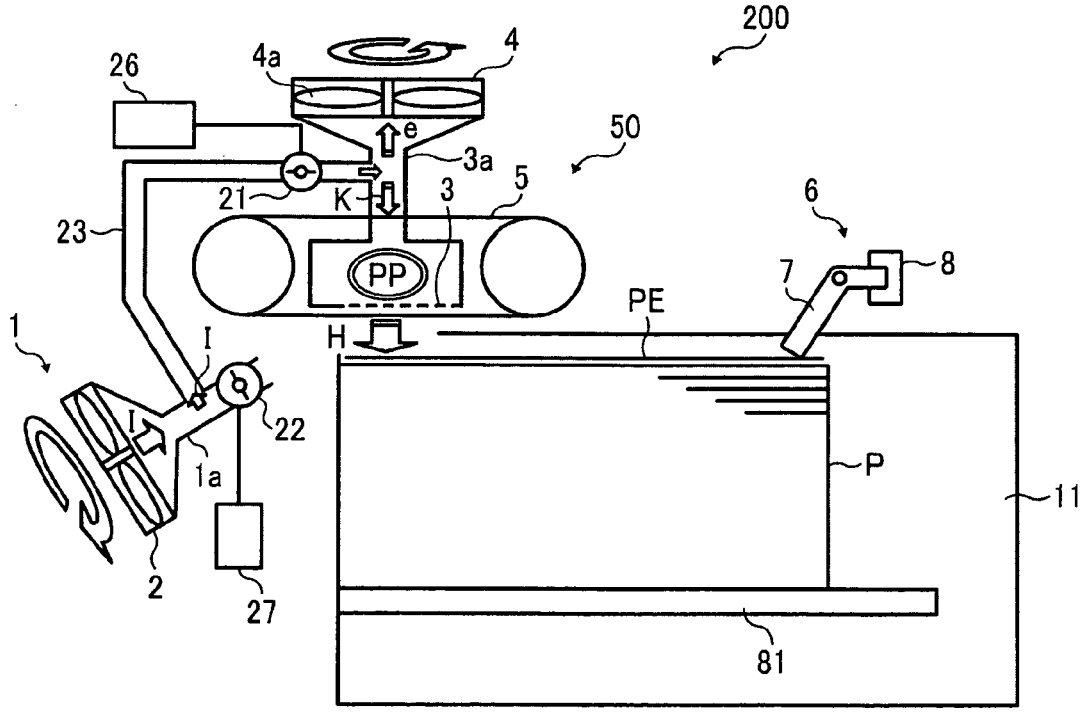
FIG. 10 is a diagram for explaining a sheet feeder according to a third embodiment of the present invention.

FIG. 10 is a diagram for explaining the sheet feeder 200 according to the third embodiment. The sheet feeder 200 of the third embodiment includes, as the positive pressure generating unit, a duct open/close valve 21, a nozzle open/close valve 22, a connecting duct 23, a duct open/close valve control unit 26, and a nozzle open/close valve control unit 27. The connecting duct 23 constitutes a flow passage connecting the duct 3*a* and the nozzle 1*a*. The duct open/close valve 21 is the valve that switches between the communication and closure of between the connecting duct 23 and the duct 3*a*. The duct open/close valve control unit 26 controls the operation and timing of the duct open/close valve 21.

The nozzle open/close valve 22 is the valve that switches between opening and closing of an end of the nozzle 1*a* further than the position of the nozzle 1*a* where the connecting duct 23 is connected. The nozzle open/close valve control unit 27 controls the operation and timing of the nozzle open/close valve 22.

During the feeding operation of the sheet feeder 200 according to the third embodiment, the duct open/close valve control unit 26 controls the duct open/close valve 21 to be closed and the nozzle open/close valve control unit 27 controls the nozzle open/close valve 22 to be open. Accordingly, the air blown from the air blower 2 is blown, as indicated by the arrow D in FIG. 4, toward the leading edge of the sheet P. After the feeding operation ends, the respective driving sources for the suction blower 4, the sheet conveyor belt 5, and the pair of carriage rollers 9 are stopped and, immediately, the duct open/close valve control unit 26 controls the duct open/close valve 21 to be open and the nozzle open/close valve control unit 27 controls the nozzle open/close valve 22 to be closed. In this case, the driving source for the air blower 2 is held in operation.

Consequently, the air blown by the air blower 2 hits the nozzle open/close valve 22 closed and, as indicated by the arrow I in FIG. 10, flows into the connecting duct 23. The air flowing into the connecting duct 23 flows into the duct 3*a* from the duct open/close valve 21 opened.

The air flowed into the duct 3*a* diverges into a flow sucked by the suction blower 4 as indicated by the arrow e in FIG. 10 and a flow blowing toward the sheet suction unit 3 as indicated by the arrow K in FIG. 10. By such air blowing, the positive pressure PP is generated in the sheet suction unit 3, and the end-of-feeding topmost sheet PE attracted on the sheet conveyor belt 5 by the suction power of the sheet suction unit 3 is immediately pushed back onto the bundle of sheets P in the feed tray 11 as indicated by the arrow H in FIG. 10.

With such a structure, the sheet feeder 200 of the first embodiment allows the sheet P to be replaced immediately after the feeding operation ends, thereby reducing loss time and enhancing the productivity.

While the conveying member that attracts the sheet P by the negative pressure generated in the sheet suction unit 3 according to the embodiments is the sheet conveyor belt 5 in endless belt form as described in the foregoing, the conveying member that attracts the sheet P is not limited to a member in endless belt form.

The sheet feeder 200 according to the embodiments includes the feed tray 11 that is a sheet housing unit, the sheet suction unit 3 that is a sheet suction unit, the suction blower 4 that is an air suction unit, and the feed unit 50 that is a sheet conveying unit. The feed tray 11 is capable of nearly horizontally stacking a plurality of sheets P. The sheet suction unit 3 sucks the topmost sheet P1 by generating the negative pressure NP at the position opposing the top surface of the topmost sheet P that is the topmost sheet positioned on top of the sheets P stacked in the feed tray 11. The suction blower 4 is connected to the sheet suction unit 3 by the duct 3*a* as an air flow passage and generates the negative pressure NP in the sheet suction unit 3 by sucking the air from the sheet suction unit 3 side. The feed unit 50 makes the topmost sheet P1 sucked by the sheet suction unit 3 to be attracted on the sheet conveyor belt 5 that is a conveying member and conveys it toward the image forming unit 101 that is in a subsequent step. In the sheet feeder 200 thus structured, by providing the positive pressure generating unit that generates the positive pressure PP and by generating the positive pressure PP in the sheet suction unit 3 by the positive pressure generating unit immediately after the feeding operation ends, the end-of-feeding topmost sheet PE can be separated from the sheet conveyor belt 5. This allows the feed tray 11 to be drawn out from the device body immediately after the feeding operation ends, thereby enhancing the productivity.

The sheet feeder 200 according to the embodiments includes the blower device 1 that is an air blower. The blower device 1 blows air near the topmost sheet P1 of the sheets P stacked in the feed tray 11 such that the topmost sheet P1 is lifted to the position where the topmost sheet P1 can be attracted on the sheet conveyor belt 5 by the negative pressure NP generated in the sheet suction unit 3. In the sheet feeder 200 thus structured, the sheets P is separated by blowing air and the topmost sheet P1 is sucked onto the sheet conveyor belt 5 to separate and convey the sheets P. Because the sheet conveyor belt 5 only conveys the sheets P that is separated by the air blowing and suction, compared with the frictional separation type sheet feeder that frictionally separates a sheet, the sheet feeder 200 according the embodiments can deal with high linear speed and high productivity.

The sheet feeder 200 according to the third embodiment includes, as the positive pressure generating unit, the duct open/close valve 21, the nozzle open/close valve 22, the connecting duct 23, the duct open/close valve control unit 26, and the nozzle open/close valve control unit 27. The connecting duct 23 is a flow passage of blowing air guiding the air flow generated by the blower device 1 that is an air blower to the sheet suction unit 3. The nozzle open/close valve 22 and the nozzle open/close valve control unit 27 are an air blowing direction switching unit that switches the direction of the air flow generated by the blower device 1 either to the direction blowing toward the sheets P in the feed tray 11 or to the direction toward the connecting duct 23. In the sheet feeder 200 of the third embodiment, by guiding the air flow blown from the blower device 1 to the sheet suction unit 3 immediately after the feeding operation ends, a positive pressure is generated in the sheet suction unit 3, thereby allowing the end-of-feeding topmost sheet PE attracted on the sheet conveyor belt 5 by the suction power of the sheet suction unit 3 to be separated from the sheet conveyor belt 5. Consequently, the feed tray 11 can be drawn out from the device body immediately after the feeding operation ends. This allows sheets to be replaced without waiting, thereby eliminating loss time and enhancing the productivity.

The sheet feeder 200 according to the first embodiment includes, as the positive pressure generating unit, the vane rotation direction control unit 40 that is a suction direction control unit controlling the direction of air suction to be reversed in the suction blower 4 that is an air suction unit. The suction blower 4 rotates the rotary vane 4*a* that is a rotating body to pump air, thus generating an air flow to generate a negative pressure in the sheet suction unit 3. Accordingly, in the sheet feeder 200 of the first embodiment, the rotating direction of the rotary vane 4*a* is controlled to reverse immediately after the feeding operation ends. This generates a positive pressure in the sheet suction unit 3 allowing the end-of-feeding topmost sheet PE attracted on the sheet conveyor belt 5 by the suction power of the sheet suction unit 3 to be separated from the sheet conveyor belt 5. Consequently, the feed tray 11 can be drawn out from the device body immediately after the feeding operation ends. This allows sheets to be replaced without waiting, thereby eliminating loss time and enhancing the productivity.

The sheet feeder 200 according to the second embodiment has, as the positive pressure generating unit, the air release valve 20 and the release valve control unit 25. The air release valve 20 is an air releasing mechanism that opens the duct 3*a* that is the air flow passage between the sheet suction unit 3 and the suction blower 4 to the air. The release valve control unit 25 is an air release control unit that controls the air release valve 20 to be opened or closed. In the sheet feeder 200 according to the second embodiment, the release valve control unit 25 controls the air release valve 20 to be opened immediately after the feeding operation ends, whereby a negative pressure in the sheet suction unit 3 is eliminated and further, the air flows in. Accordingly, a positive pressure in the sheet suction unit 3 is generated, thus allowing the end-of-feeding topmost sheet PE attracted on the sheet conveyor belt 5 by the suction power of the sheet suction unit 3 to be separated from the sheet conveyor belt 5. Consequently, the feed tray 11 can be drawn out from the device body immediately after the feeding operation ends. This allows sheets to be replaced without waiting, thereby eliminating loss time and enhancing the productivity.

The copier 100 as an image forming apparatus according to the embodiments includes the image forming unit 101 that forms an image on the sheet P as a recording medium, and the sheet feeder 200 that feeds the sheet P to the image forming unit 101. With the sheet feeder 200, sheets can be replaced without waiting after an image forming operation ends. Thus, it is possible to achieve high productivity without loss time.

As described above, according to an embodiment of the invention, in the sheet feeder, the positive pressure generating unit generates a positive pressure in the sheet suction unit immediately after feeding operation ends. This allows a sheet to be separated from the conveying member, and makes it possible to draw out the feed tray from the device body immediately after the feeding operation ends.

Moreover, since the feed tray can be drawn out from the device body immediately after the feeding operation ends, the productivity can be increased.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeder, comprising:

a feed tray configured to contain a stack of sheets;

an air blower near a topmost sheet on top of the sheets stacked in the feed tray;

a sheet suction unit that sucks the topmost sheet on top of the sheets stacked in the feed tray by a negative pressure generated at a position facing a top surface of the topmost sheet;

an air suction unit that is connected to the sheet suction unit via an air flow passage and that sucks air from a sheet suction unit side to generate the negative pressure in the sheet suction unit;

a sheet conveying unit that includes a conveying member and that attracts the topmost sheet sucked by the sheet suction unit on the conveying member and conveys the topmost sheet toward a pair of carriage rollers located in a downstream side in a conveying direction and disposed parallel to the sheet conveying unit; and a positive pressure generating unit that generates a positive pressure in the sheet suction unit, the positive pressure generating unit includes:

an air releasing mechanism that opens the air flow passage between the sheet suction unit and the air suction unit to atmosphere, and an air release control unit that controls the air releasing mechanism to be opened and closed, wherein when the feeding operations ends, the respective driving sources of the air blower, the air suction unit, the sheet conveying unit, and the pair of carriage rollers are stopped and the air release control unit immediately controls the air releasing mechanism to be opened.

2. The sheet feeder according to claim 1, wherein the air blower blows air near the topmost sheet of the sheets stacked in the feed tray to lift the topmost sheet to a position where the topmost sheet is attracted on the conveying member by the negative pressure generated in the sheet suction unit.

3. The sheet feeder according to claim 2, wherein the positive pressure generating unit includes a blowing air flow passage that guides an air flow generated by the air blower to the sheet suction unit, and an air blowing direction switching unit that switches a direction of the air flow generated by the air blower between a direction toward the sheets and a direction toward the blowing air flow passage.

4. The sheet feeder according to claim 1, wherein the positive pressure generating unit includes a suction direction control unit that controls a direction in which the air suction unit sucks air to be reversed.

5. The sheet feeder according to claim 1, wherein the air suction unit pumps air by rotating a rotary vane to generate air flow, whereby a negative pressure is generated on one side of a rotation axis of the rotary vane as a suction side and a positive pressure is generated on the other side as an exhaust side.

6. The sheet feeder according to claim 5, wherein the suction side and the exhaust side are inverted when the rotary vane is reversed.

7. The sheet feeder according to claim 1, wherein a conveyance force generated by the pair of carriage rollers is set greater than that of the sheet conveying unit.

8. The sheet feeder according to claim 1, wherein a conveyance force given to the sheet by the pair of carriage rollers is substantially greater than a force to stop conveying the sheet via the sheet conveying unit.

9. The sheet feeder according to claim 1, further comprising a sensor on a downstream side in the conveying direction with respect to the pair of carriage rollers.

10. The sheet feeder according to claim 1, wherein the negative pressure in the sheet suction unit is continuously formed even after an operation of the air suction unit stops.

11. The sheet feeder according to claim 1, wherein the air blower includes a rotary vane to generate air flow through a nozzle.

12. The sheet feeder according to claim 11, wherein the air blower includes:

a nozzle mechanism that opens and closes the air flow in the air blower; and a nozzle mechanism control unit that controls the operation and timing of the nozzle mechanism.

13. The sheet feeder according to claim 12, further comprising a connecting duct connecting the air flow passage in the air suction unit and the nozzle in the air blower.

14. The sheet feeder according to claim 1, wherein air flowing into the air flow passage diverges into the air suction unit and the sheet suction unit.

15. An image forming apparatus, comprising:

an image forming unit that forms an image on a sheet as a recording medium; and a sheet feeder that feeds the sheet to the image forming unit, the sheet feeder Including;

a feed tray configured to contain a stack of sheets;

an air blower near a topmost sheet on top of the sheets stacked in the feed tray;

a sheet suction unit that sucks the topmost sheet on top of the sheets stacked in the feed tray by a negative pressure generated at a position facing a top surface of the topmost sheet;

an air suction unit that is connected to the sheet suction unit via an air flow passage and that sucks air from a sheet suction unit side to generate the negative pressure in the sheet suction unit;

a sheet conveying unit that includes a conveying member and that attracts the topmost sheet sucked by the sheet suction unit on the conveying member and conveys the topmost sheet toward a pair of carriage rollers located in a downstream side in a conveying direction and disposed parallel to the sheet conveying unit; and a positive pressure generating unit that generates a positive pressure in the sheet suction unit, the positive pressure generating unit includes:

an air releasing mechanism that opens the air flow passage between the sheet suction unit and the air suction unit to atmosphere, and an air release control unit that controls the air releasing mechanism to be opened and closed, wherein when the feeding operations ends, the respective driving sources of the air blower, the air suction unit, the sheet conveying unit, and the pair of carriage rollers are stopped and the air release control unit immediately controls the air releasing mechanism to be opened.

* * * * *